US007353851B2

(12) United States Patent
Sterner et al.

(10) Patent No.: US 7,353,851 B2
(45) Date of Patent: Apr. 8, 2008

(54) BULK BAG FILLER WITH HOOK LATCH MECHANISM

(75) Inventors: Keith W. Sterner, Bethlehem, PA (US); David R. Gill, Stewartsville, NJ (US); John F. Simonof, Jr., Easton, PA (US)

(73) Assignee: Flexicon Corporation, Bethlehem, PA (US)

( * ) Notice: Subject to any disclaimer, the term of this patent is extended or adjusted under 35 U.S.C. 154(b) by 222 days.

(21) Appl. No.: 11/349,467

(22) Filed: Feb. 7, 2006

(65) Prior Publication Data

US 2006/0185762 A1 Aug. 24, 2006

Related U.S. Application Data

(60) Provisional application No. 60/650,602, filed on Feb. 7, 2005.

(51) Int. Cl.
*B65B 1/04* (2006.01)

(52) U.S. Cl. ..... 141/316; 141/10; 141/114; 141/166; 141/314

(58) Field of Classification Search ..... 141/2, 141/10, 114, 129, 166, 314–316; 177/74; 248/95

See application file for complete search history.

(56) References Cited

U.S. PATENT DOCUMENTS

| | | | | |
|---|---|---|---|---|
| 5,056,571 | A * | 10/1991 | Derby | 141/114 |
| 5,165,455 | A * | 11/1992 | De Crane | 141/10 |
| 5,269,579 | A * | 12/1993 | DeCrane | 294/81.56 |
| 5,787,945 | A * | 8/1998 | Riemersma | 141/314 |
| 5,975,155 | A * | 11/1999 | Sienerth et al. | 141/84 |
| 6,112,504 | A * | 9/2000 | McGregor et al. | 53/417 |
| 6,149,110 | A | 11/2000 | Gill et al. | |
| 6,176,278 | B1 | 1/2001 | Gill et al. | |

FOREIGN PATENT DOCUMENTS

| | | |
|---|---|---|
| GB | 394833 | 7/1933 |

* cited by examiner

*Primary Examiner*—Timothy L. Maust
(74) *Attorney, Agent, or Firm*—Volpe and Koenig, P.C.

(57) ABSTRACT

A bulk bag filler is provided having a frame assembly, a bag filling head, rotatable hooks for engaging bag loops and latch assemblies to engage the rotatable hooks. Each of the latch assemblies include an actuatable latch pin to release the rotatable hook, and upon release, the latch assemblies are gravity driven to return to a latching position in which the rotatable hooks are re-engageable. A method for loading a bulk bag with a bulk material is also provided.

20 Claims, 7 Drawing Sheets

BULK BAG FILLER WITH HOOK LATCH MECHANISM

BACKGROUND

The present invention generally relates to a bulk bag filler. More particularly, the invention relates to a bag holding device which allows easier loading, unloading and movement of bags.

Large bag like containers are often used for the shipment of bulk materials from one location to another. These bulk bags have a capacity ranging from twenty cubic feet up to seventy cubic feet or more, and may vary in size from thirty-five inches wide by thirty-five inches long by twenty-three inches high up to the same width and length bag having a height of eighty-two inches unfilled.

These bags are constructed with bag loops on the top of the bag which are used for holding the bags while they are being filled with bulk material in a filling machine or when the bulk material is being discharged in a bulk bag discharger. The bag loops are generally constructed of a strong web-like material which is sewn onto the upper corners of the generally square bag. The bulk bags also include an upper inlet spout which is connected to a bag filling apparatus provided in conjunction with the holding apparatus, as well as a lower discharge spout. The material to be loaded into the bag is fed through the filling apparatus, through the inlet spout, and into the bag.

Many prior art bag holding devices include hooks for holding the bag loops while the bag is filled. The hooks are mounted on a filing head which can be moveably mounted on the bag filler frame frame. A typical holding apparatus includes either four posts at the corners of the device, or two posts at the center or rear of the device. The frame can be set at a fixed position or can be movably mounted for up and down using hydraulics, pneumatics or screw drives. Various other drives have been proposed, such as disclosed in the inventors' prior U.S. Pat. No. 6,176,278.

One problem of the prior devices, that entails a high cost, is the need for large actuators used to actuate the hooks that hold the bag loops that allow for holding the bulk bag during filling, and can be released when the bulk bag is full. Additionally, due to the known designs, removal and installation of the filling head assembly is difficult. As such, there is a need for a bag holding apparatus which allows easier attachment and release of a bag for loading or unloading, while allowing reduced cost and ease of assembly and maintenance.

SUMMARY

The present invention relates to a bulk bag filler including a frame assembly, a bag filling head, and latch assemblies. The bag filling head is connected to the frame assembly and includes a plurality of rotatable hooks to which the bag loops are connectable. The latch assemblies are located on the filling head and are gravity driven to a latching position to engage the rotatable hooks. Upon release of a latch pin in each latch assembly, the latch assemblies release the rotatable hooks, and then are returned by the force of gravity to the latching position.

A method for loading a bulk bag with a bulk material is also provided. The method includes connecting a bulk bag to a bag filling head of a bulk bag filler by connecting bulk bag loops of the bulk bag to moveable hooks connected to the bag filling head. The moveable hooks are moved to a latched position in which they are engaged by gravity driven latch assemblies connected to the bag filling head. The bulk bag is filled with a bulk material, and the gravity driven latch assemblies are disengaged to release the moveable hooks. The filled bulk bag is then disconnected from the bag filling head, and the gravity driven latch assemblies are returned to a latching position.

BRIEF DESCRIPTION OF THE DRAWINGS

The foregoing Summary as well as the following detailed description will be readily understood in conjunction with the appended drawings which illustrate preferred embodiments of the invention. In the drawings.

DETAILED DESCRIPTION OF THE PREFERRED EMBODIMENTS

Figure 1:
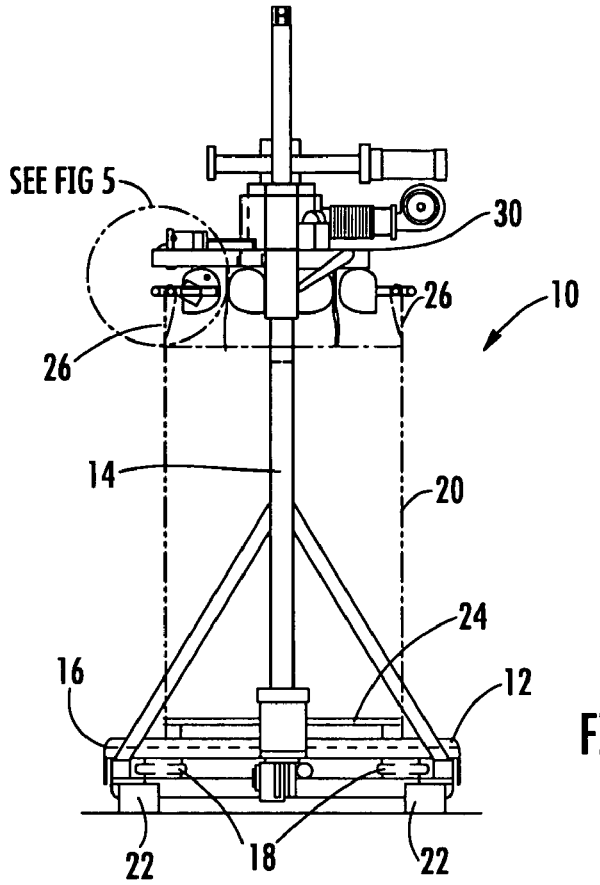
FIG. 1 is a side elevation view of a preferred embodiment of the present invention.

Certain terminology is used in the following description for convenience only and is not considered limiting. The words "right," "left," "lower" and "upper" designate directions in the drawings to which reference is made. This terminology includes the words specifically noted above, derivatives thereof and words of similar import. Additionally, the terms "a" and "one" are defined as including one or more of the referenced items unless specifically noted.

Referring to FIG. 1, a bulk bag filler 10 in accordance with the present invention is shown. The bulk bag filler 10 generally comprises a base 12, vertical supports 14 and a bag filling head 30.

The base 12 may include a platform 16 supported by air springs 18 that are used to vibrate the bag to deaerate and densify the loaded material. By raising the platform 16 with the air springs 18 prior to vibration, the vibration can be concentrated on the bag 20 and away from the remainder of the bulk bag filler 10.

The base 12 preferably sits on load cells 22 which measure the total weight of the bulk bag filler 10 and the bag 20. The weight of the contents of the bag 20 can then be determined and controlled.

The bag 20 preferably rests on a pallet 24 loaded onto the platform 16, but may be positioned directly on the platform 16. The pallet 24 allows a filled bag to be removed from the bulk bag filler 10 with a forklift.

Figure 2:
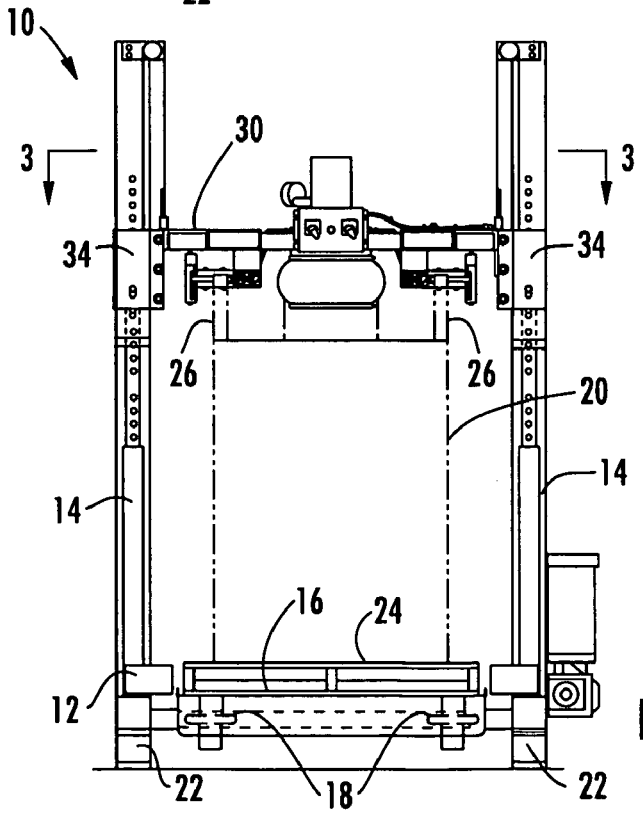
FIG. 2 is a front elevation view of the embodiment of FIG. 1.

Referring to FIGS. 1 and 2, the vertical supports 14 may allow the bag filling head 30 to be adjustable in height, for example as shown in U.S. Pat. No. 6,176,278, which is incorporated herein by reference as if fully set forth, or fixed.

Figure 3:
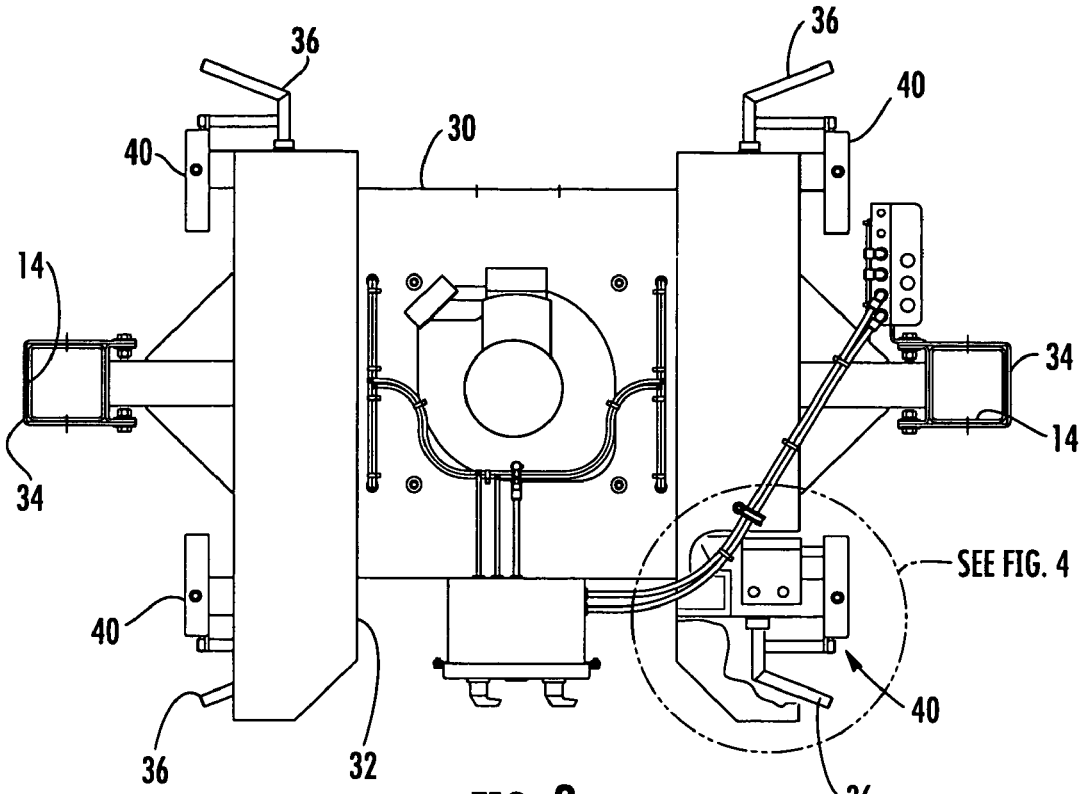
FIG. 3 is a plan view taken along the line 3-3 in FIG. 2.

The bag filling head 30 is shown in FIGS. 1 through 4, and includes a frame 32 preferably formed of welded steel or another suitable material. Sleeves 34 are removably mountable on the frame 32 to engage the vertical posts 14. Each of the sleeves 34 is dimensioned to fit over and move vertically on a respective one of the posts 14. The sleeves 34 guide the vertical movement of the bag filling head 30 as it is being set in position based on the size of the bulk bag being filled. As best shown in FIG. 3, the sleeves 34 are preferably formed of bent-up sheet metal formed into a generally U-shape that can be fit over a respective one of the vertical posts 14 after the frame 32 of the bag filling head 30 is positioned between the posts 14. This avoids the need to lift the frame 32 above the posts 14 and then drop it down in position over the posts, as in the prior art devices. Preferably, the sleeves 34 are connected to the frame 32 with removable fasteners, such as bolts.

The bag filling head 30 may be raised and lowered using a cable assembly, as shown in FIG. 2. However, hydraulic, pneumatic or mechanical actuators could be utilized, if desired. Alternatively, the bag filling head 30 can be raised or lowered using a forklift, and then pinned or fixed in the appropriate position. The bag filling head 30 is therefore movable to the proper height for filling a particular sized bag. The height will depend on the size of the bag 20, the length of the loops 26, and whether the bag 20 will be suspended during filling or rest on the platform 16.

Referring to FIG. 3, the bag filing head 30 includes rotatable hooks 36 to which the bag loops 26 are connected. The rotatable hooks 36 are preferably located at the four corners of the bag filling head 30 and are releasably held in a closed position via respective latch assemblies 40 to support bag loops 26 of the bulk bag 20.

Figure 4:
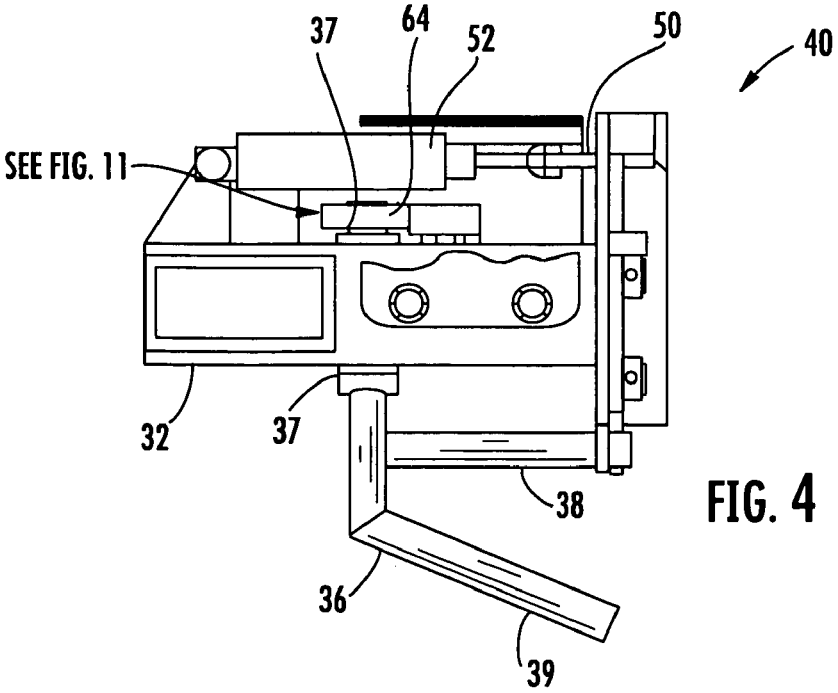
FIG. 4 is an enlarged view of the latch assembly shown in FIG. 3.

Referring to FIG. 4, each rotatable hook 36 includes a support bar 38 over which the bag loop 26 is placed, and a handle 39 which can be manually grasped by a user in order to return the rotatable hook 36 to a latched position, as explained in further detail below. The rotatable hook 36 is preferably mounted in bearings 37 to allow for a free pivoting movement on the frame 32. The latch assembly 40 is released via a latch pin 50 that is moved from a latch position in which the latch pin 50 is extended outwardly, as explained in more detail below, to a second unlatched position, in which a latch pin actuator 52, supported on the frame 32, withdraws the latch pin 50 so that the latch assembly 40 releases the rotatable hook 36 so that a bag loop 26 can be released once a bulk bag 20 has been filled.

Figure 5:
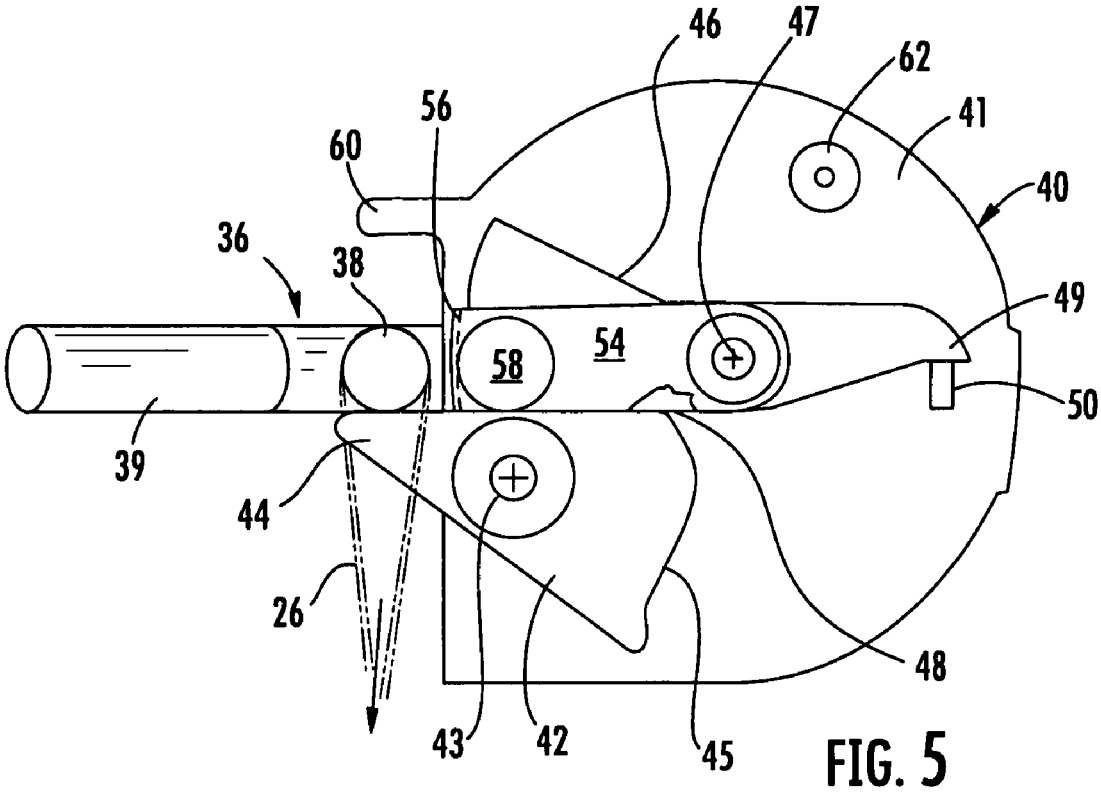
FIG. 5 is an enlarged side elevation view of the latch assembly shown in FIG. 1, shown in the closed position supporting the rotatable hook.
Figure 5A:
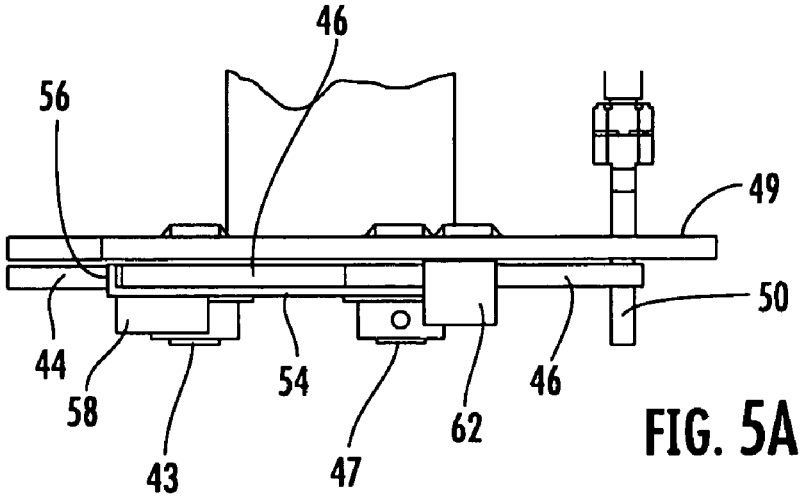
FIG. 5A is a top plan view of the latch assembly in the position shown in FIG. 5, with the rotatable hook hidden for clarity.

Referring to FIGS. 5 and 5A, a side view and a top view respectively of one latch assembly 40 with the protective cover removed is shown in the latched position. The latch assembly 40 includes a latch base 41, preferably formed of metal plate to which the latch components are mounted. A hook support arm 42 is pivotably mounted about a first pivot point 43. The hook support arm 42 includes a first, hook support end 44, shown on the left side of the first pivot point 43, and a second counter weight end 45, shown on the right side of the hook support arm 42 in FIG. 5. The hook support arm 42 is freely pivotable about the first pivot point 43. A locking arm 46 is used to hold the hook support arm 42 in the latched position in order to support the support bar 38 of the respective rotatable hook 36. The locking arm 46 is freely pivotable about a second pivot point 47 and includes a first end 48 with a hook support contact surface, shown in detail in FIGS. 7-10, and a second, latch contact end 49 which contacts the latch pin 50 in the latch position as shown. The first end 48 of the locking arm 46 extends far enough past the first pivot point 43 so that it cannot drop past the hook support arm 42. A stop 62 is provided to prevent excess motion in the opposite direction.

A pivoting reset weight arm 54 is also pivotably mounted at the second pivot point 47. The pivoting reset weight arm 54 is freely pivotable separately from the locking arm 46 and is pivotably mounted at its first end about the second pivot point 47. The second end includes a flange 56 which allows the pivot reset weight arm 54 to contact the hook support arm 42, to the left of the first pivot point 43, as shown in FIG. 5. A counter weight 58 is mounted at the second end of the pivoting reset weight arm 54 which is used in resetting the hook support arm 42 during re-latching of the support bar 38 of the rotatable hook 36. A support bar stop 60 is preferably located on the latch base 41 which prevents over travel in the upward direction of movement of the rotatable hook 36 during the re-latching process.

In the latched position shown in FIG. 5, the weight of the bulk bag acts downwardly through the bag loop 26, pulling the support bar 38 downwardly into contact with the support end 44 of the hook support arm 42. This places a counter clockwise moment on the hook support arm 42 about the first pivot point 43, resulting in the upper right hand portion of the second end of the hook support arm 42 acting against the hook support contact surface on the first end 48 on the locking arm 46. This induces a clockwise moment into the locking arm 46 about the second pivot point 47 causing the latch contact portion 49 on the second end of the locking arm 46 to press against the latch pin 50, which is in the extended (extending outwardly from the page) position in FIG. 5.

Figure 6:
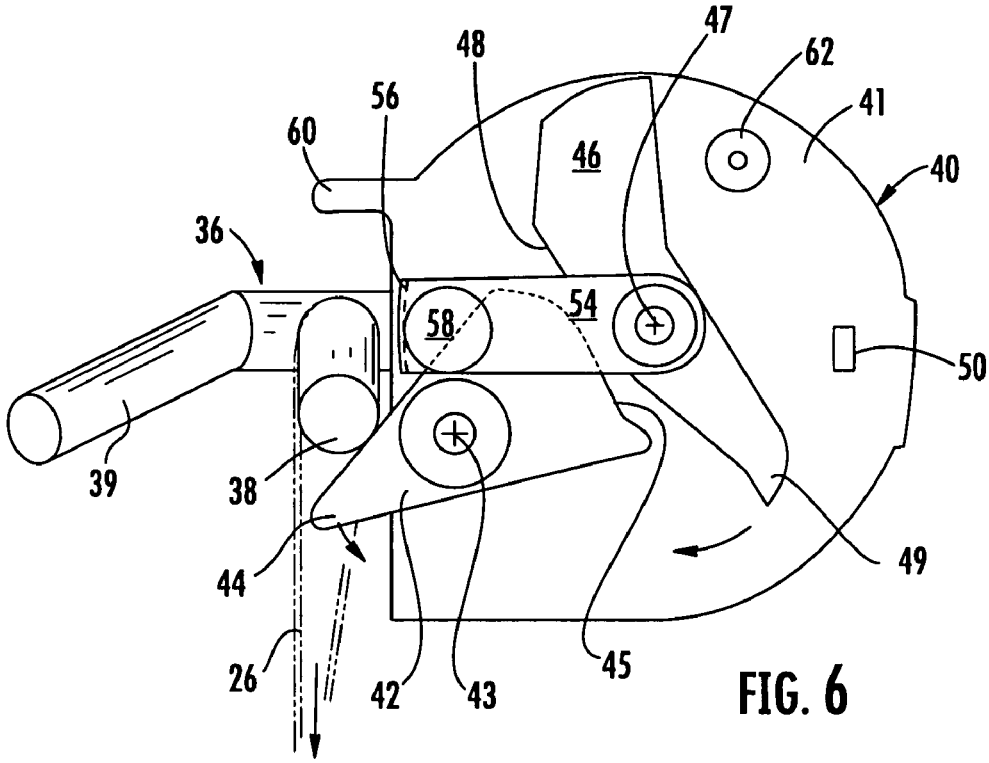
FIG. 6 is a view similar to FIG. 5, showing the movement of the latch assembly to release a bag loop after the latch pin is withdrawn.

In order to release the bag loops 26 of a bulk bag 20 from the bag filling head 30, for example when the bulk bag 20 is filled, the latch pin actuators 52 are actuated and the latch pins 50 are withdrawn in a direction into the page in FIGS. 5 and 6. The downward force from the bag loop 26 pulls the support bar 38 of the rotatable hook 36 downwardly. With the latch pin 50 being withdrawn, nothing prevents the counter clockwise moment on the hook support arm 42 from rotating the hook support arm 42 counter clockwise, such that the support end 44 drops, allowing the rotatable hook 36 to release. As the hook support arm 42 pivots counter clockwise, its second end 45 with the counter weight causes the locking arm 46 to be driven clockwise via contact with the second end 45 as of the hook support arm 42.

Figure 7:
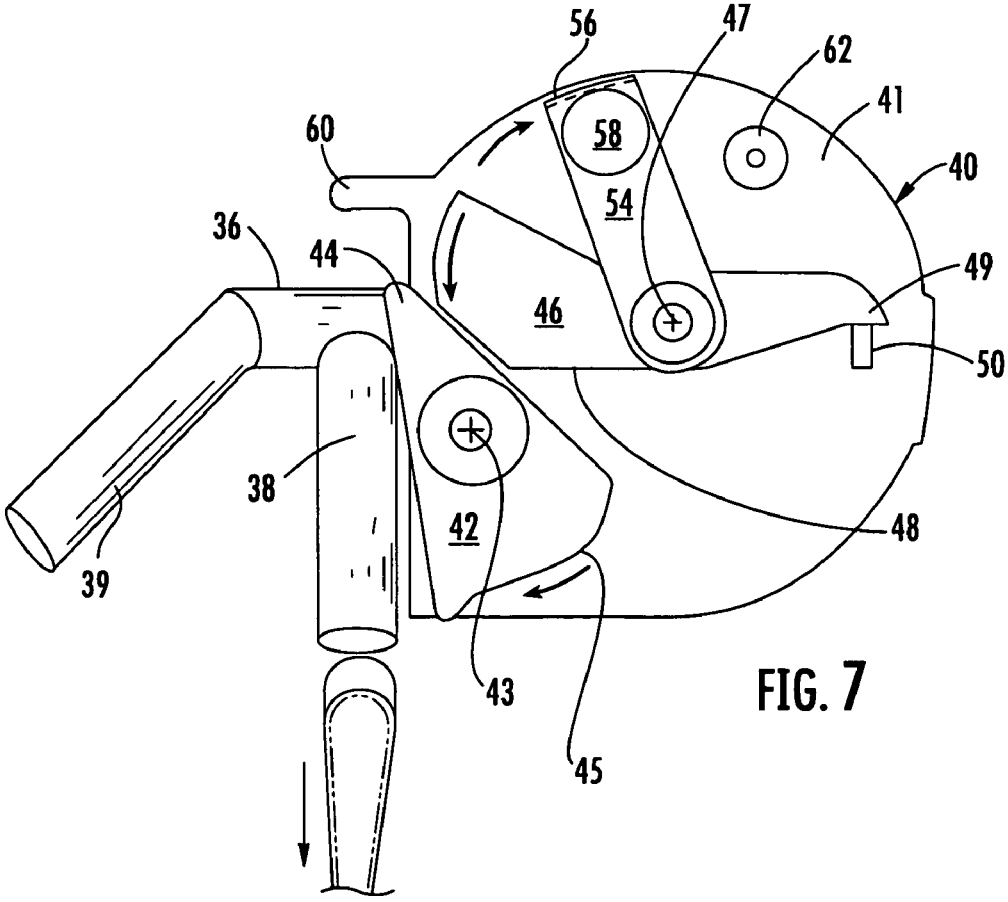
FIG. 7 is a view similar to FIG. 6, showing the rotatable hook in the disengaged position with the bag loop releasing, and the hook support arm swinging upward due to gravity.

Referring to FIG. 7, once the support bar 38 of the rotatable hook 36 drops below the support end 44 of the hook support arm 42, the hook support arm 42 pivots clockwise due to the second end 45, counter weight having a greater mass than the support end 44. At the same time, the locking arm 46 pivots counter clockwise due to the heavier mass of the first end 48. Depending on the speed of release, the pivoting reset weight arm 54 may be driven in a clockwise direction due to the clockwise rotation of the locking arm 46. For the sake of clarity, the pivoting reset weight arm 54 is shown in a higher position than it might actually travel in FIG. 7. In any event, the stop 62 would prevent over rotation of the pivoting reset weight arm 54 and the locking arm 46.

Figure 8:
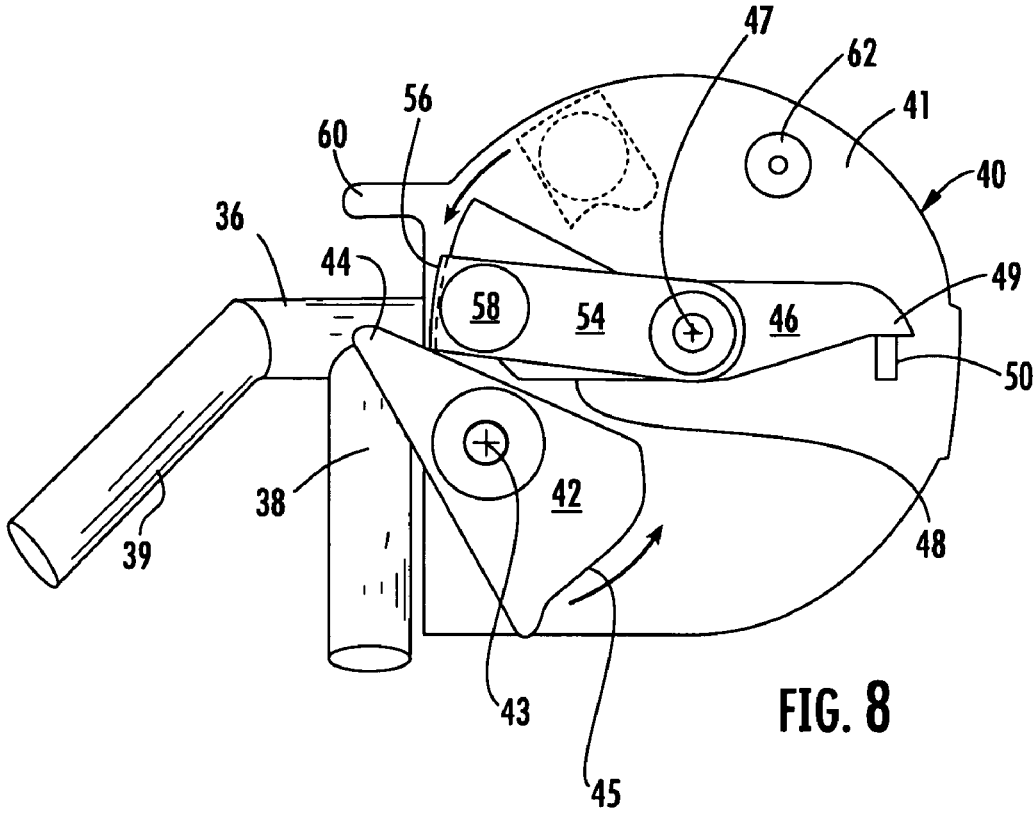
FIG. 8 is a view similar to FIG. 7, showing the pivoting reset weight acting on the hook support arm to push it into a position for latching.
Figure 9:
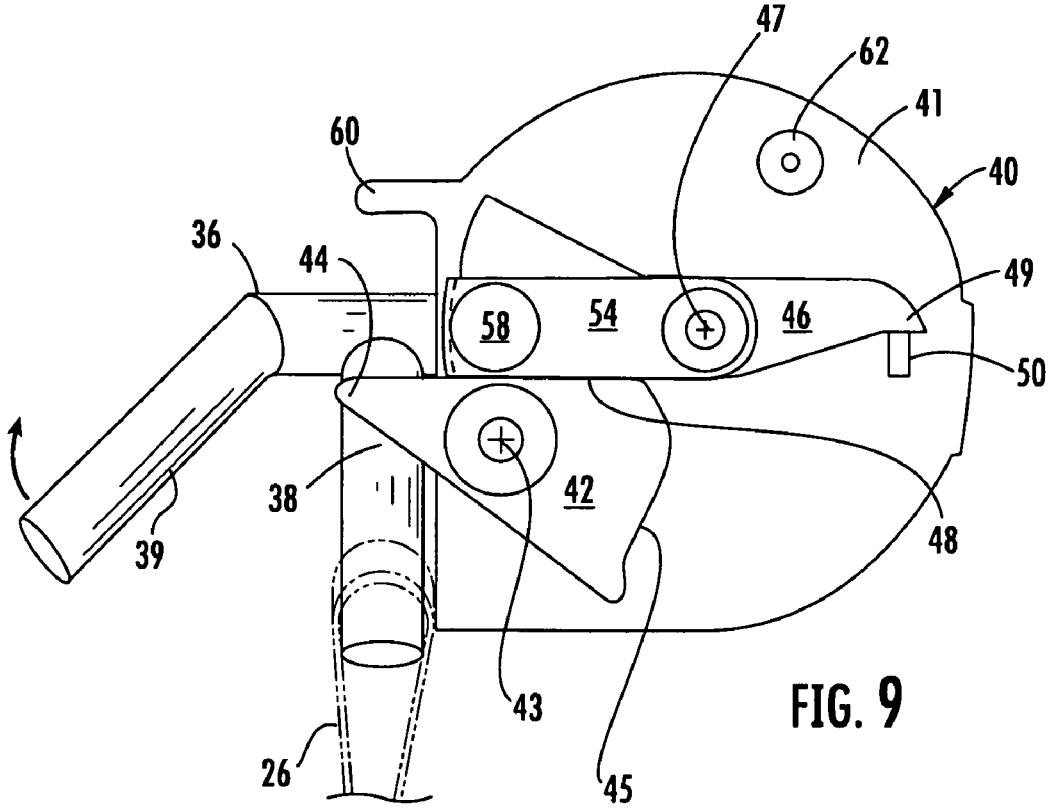
FIG. 9 is a view similar to FIG. 8, showing the bag loop from an empty bag being placed on the rotatable hook, prior to the rotatable hook being re-latched into position for bag filling.
Figure 10:
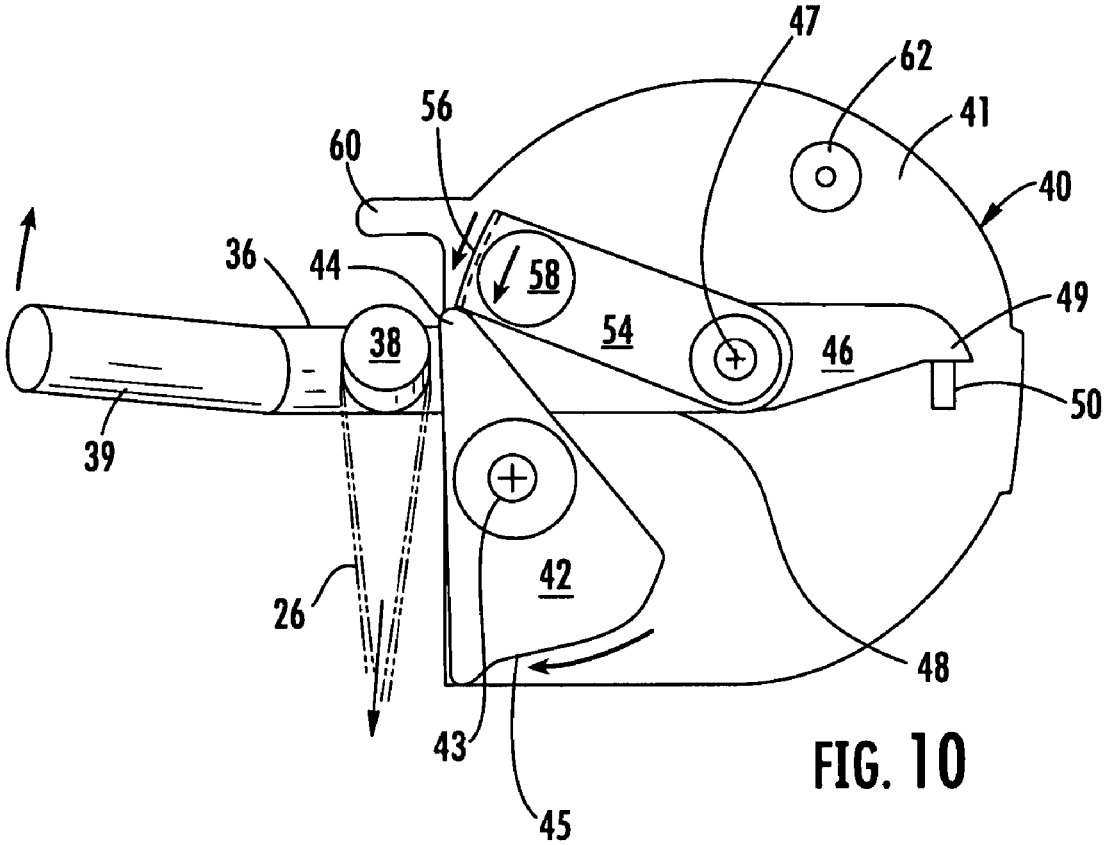
FIG. 10 is a view similar to FIG. 9, showing the rotatable hook in the process of being re-latched, with the hook support arm pivoting upwardly against the force of the pivoting reset weight.

Referring to FIG. 8, the pivoting reset weight arm 54 is shown counteracting the counter weight 45 on the second end of the hook support arm 42 in order to push the hook support arm 42 in a counter clockwise direction toward a re-latching position. The latch pin actuator 52 also returns the latch pin 50 to the extended, latching position. The counter weight 58 has a large enough mass such that the moment created by the counter weight 45 formed by the second end of the hook support arm 42 is overcome in order to return the hook support arm 42 to a position for re-latching, as shown in FIG. 9. A user can then place the bag loop 26 from a new bag 20 being attached to the bulk bag filler 10 in position on the support bar 38 and then rotate rotatable hook 36 upwardly via the handle 39. The support bar 38 contacts the underside of the first, support end 44 of the hook support arm 42, which pivots in the clockwise direction, as shown in FIG. 10, which also rotates the pivoting reset weight arm 54 in the clockwise direction against the force of the counter weight 58. The locking arm 46 is maintained generally in position based on its configuration, shown most clearly in FIG. 7, which allows the hook support arm 42 to rotate clockwise to a position such that the support bar 38 of the rotatable hook 36 can pass upwardly beyond the support end 44 of the hook support arm 42, at which point, gravity acting on the counter weight 58 drives the pivoting reset weight arm 54 in the counter clockwise direction, overcoming the moment created by the counter weight 45 of the second end of the hook support arm 42, returning the latch assembly 40 to the latched position, as shown in FIG. 5.

The latch assembly 40 can be simply and economically manufactured since both the hook support arm 42 and the locking arm 46 are flat plate material. Due to the contact location of the second end of the hook support arm 42 on the hook support contact area on the first end 48 of the locking arm 46, and the longer moment arm between the latch pin contact end 49 of the locking arm 46, the load on the latch pin 50 is considerably lower than the load which can be carried by the support ends 44 of the hook support arms 42, which can be, for example in excess of 2,500 pounds. The pivoting reset weight arm 54 is also easily manufactured as a brake formed part in order to form the flange 56 which contacts the first, support end 44 of the hook support arm 42. In a preferred embodiment, the hook support arm 42 and the locking arm 46 are preferably made of 0.125 or thicker steel plate and the pivoting reset weight arm 54 is made of 0.032 sheet metal and includes a separate counter weight 58 which can be attached via mechanical fasteners, welding or any other suitable means.

While FIGS. 5-10 show a "right hand" version of the latch assembly 40, those skilled in the art will recognize that in the preferred embodiment a "left hand" version is required at two locations on the frame 32. Since the latch base 41, hook support arm 42 and the locking arm 46 are all made of flat material, they can easily be utilized to form the "left hand" version by assembly on the opposite side of the base plate 41, and the same reset weight arm 54 can also be utilized. This allows for reduced inventory and ease of assembly since the same components are utilized to form both the left and right hand versions of the latch assembly 40.

The latch assemblies 40 preferably have an overall thickness on the order of approximately 1 inch or less and provide an automatic resetting function to a re-latching position based on the configuration of the hook support arm 42 with the counter weight 45 formed by the enlarged second end, the locking arm 46 having a heavier first end 48, and the freely pivoting recess weight arm 54. Additionally, the latch pin actuator 52 can be of a relatively small size in comparison with the prior known rotatable hook assembly since the load on the latch pin 50 is carried in shear directly into the latch pin opening in the latch base 41, and the latch pin actuator 52 needs only to overcome the friction force based on sliding contact with the second, latch contact end 49 of the locking arm 46. This allows for a smaller and more economically manufactured latching assembly, which automatically returns to a re-latching position after being released. Therefore a user resetting the rotatable hooks 36 after bag loops 26 from a new bulk bag 20 have been connected does not have to worry about a powered mechanism acting while the user is positioning the new bulk bag to be filled.

Figure 11:
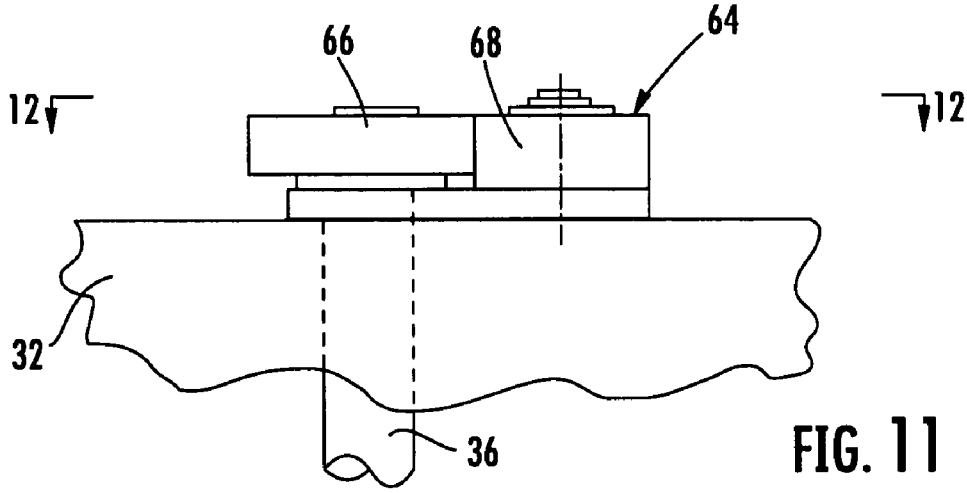
FIG. 11 is an enlarged view of the brake assembly for the rotatable hook shown in FIG. 4.
Figure 12:
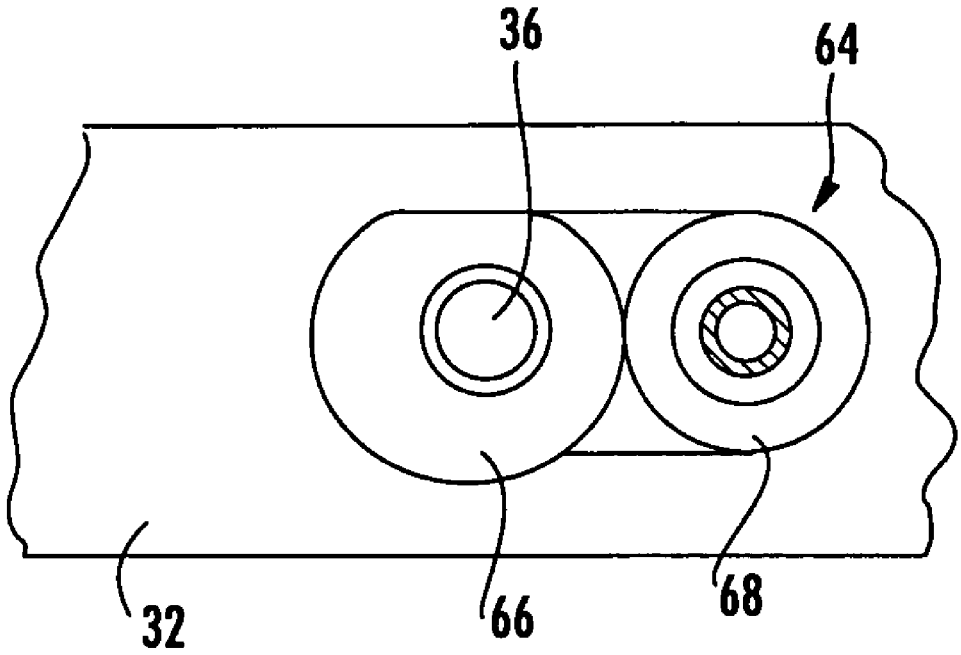
FIG. 12 is an elevation view of the brake cam and roller shown in FIG. 11.

Referring now to FIGS. 4, 11 and 12, a brake assembly 64 for one of the rotatable hooks 36 is shown in detail. The brake assembly includes a cam 66 mounted to the end of the rotatable hook 36 on the opposite side of the frame member from the support bar 38. The cam 66 is fixed to and rotates with the rotatable hook 36, and preferably has a cam rise of between 0.125 and 0.375 inches. In a preferred embodiment, the cam rise is about 0.25 inches. The cam 66 engages a roller 68 made at least partially of a compressible material. Preferably, the roller 68 is made of a medium durometer rubber or synthetic rubber material, with a durometer of about 50 to 70, and more preferably about 60. As the rotatable hook 36 drops to release a bag loop 26, the rising profile of the cam 66 is forced against the roller 68, causing greater compression of the roller 68, thus braking the rotation of the rotatable hook 36. Preferably, if the rotatable hook 36 is released by the latch assembly 40 in a no load state, it will rotate downwardly about 30° to 60°, and more preferably about 45°. Upon release of the rotatable hook 36 under the weight load of a filled bulk bag 20, the rotatable hook 36 only rotates downwardly up to about a maximum of 100°, and more preferably is braked in a position in which the support bar 38 is rotated downwardly to an angle of between 70° and 90°. This provides a simple and reliable braking function for the rotatable hooks 36 to prevent over travel and/or potential injury due to unrestricted free rotational movement. Those skilled in the art will recognize that the cam rise of the cam 66 and the durometer of the roller 68 can be adjusted for the particular application depending on the particular requirements.

It will be recognized by those skilled in the art that the latch assembly 40 in accordance with the present invention can be used in connection with any other equipment that requires releasable holding of suspended loops or straps.

It will be appreciated by those skilled in the art that changes can be made to the embodiment of the invention described above without departing from the broad inventive concept thereof. It is also understood that various portions of the invention can be used alone or in combination and that not all of the components are required for any particular application. It is therefore understood that this invention is not limited to the particular embodiment disclosed, but it is intended to cover modifications within the spirit and scope of the present invention.

We claim:

1. A bulk bag filler comprising:

a frame assembly;

a bag filling head connected to the frame assembly;

a plurality of rotatable hooks, to which bulk bag loops are connectable, located on the bag filling head; and a plurality of latch assemblies, each of the latch assemblies allocated to one of the rotatable hooks and located on the bag filling head adjacent to the one of the rotatable hooks, and the latch assemblies each comprising an actuatable latch pin to release a hook support arm that supports the rotatable hook, and upon release, the latch assemblies are gravity driven to return the hook support arm to a latching position in which the rotatable hooks are re-engageable.

2. The bulk bag filler according to claim 1, wherein each of the latch assemblies comprises:

a latch base;

the hook support arm pivotably attached to the latch base, the hook support arm being in removable contact with the rotatable hook; and a locking arm pivotably attached to the latch base, the locking arm having a first end in removable contact with the hook support arm for retaining the hook support arm in the latching position;

wherein the actuatable latch pin is in removable contact with a second end of the locking arm to release the locking arm thereby to release the hook support arm.

3. The bulk bag filler according to claim 1, wherein each of the latch assemblies further comprises a reset weight arm pivotably attached to the latch base, the reset weight arm being in removable contact with the hook support arm for biasing the hook support arm to the latching position.

4. A releasable attachment system for a bulk bag filler having a bag filling head, the attachment system comprising:

a plurality of rotatable hooks, to which bulk bag loops are connectable, for connection to a bag filling head; and a plurality of latch assemblies, each of the latch assemblies allocated to one of the rotatable hooks and located on the bag filling head adjacent to the one of the rotatable hooks, the latch assemblies each comprising an actuatable latch pin to release the rotatable hooks, and at least one gravity driven component for returning the latch assemblies to a latching position in which the rotatable hooks are re-engageable.

5. The releasable attachment system according to claim 4, wherein each of the latch assemblies further comprises:

a latch base;

a hook support arm pivotably attached to the latch base, the hook support arm being in removable contact with a respective one of the plurality of rotatable hooks; and a locking arm pivotably attached to the latch base, the locking arm being in removable contact with the hook support arm for retaining the hook support arm in the latching position.

6. The releasable attachment system according to claim 5, wherein the hook support arm comprises:

a first hook support arm end for supporting a respective one of the rotatable hooks; and a second hook support arm end opposite the first end having a greater mass than the first hook support arm end for counter-weighting the first hook support arm end;

and wherein the locking arm comprises:

a first locking arm end which removably contacts the hook support arm; and a second locking arm end, having a lesser mass than the first locking arm end, which removably contacts the latch pin.

7. The releasable attachment system according to claim 4, further comprising:

a cam connected to at least one of the rotatable hooks; and a roller for connection to the bag filling head in contact with the cam for providing a controlled movement of the at least one of the rotatable hooks.

8. A releasable attachment system for a bulk bag filler having a bag filling head, the attachment system comprising:

a plurality of rotatable hooks, to which bulk bag loops are connectable, for connection to a bag filling head; and a plurality of latch assemblies, each of the latch assemblies allocated to one of the rotatable hooks and located on the bag filling head adjacent to the one of the rotatable hooks, the latch assemblies each comprising:

a latch base;

a hook support arm pivotably attached to the latch base at a first pivot point, the hook support arm being in removable contact with a respective one of the plurality of rotatable hooks;

a locking arm pivotably attached to the latch base at a second pivot point, the locking arm being in removable contact with the hook support arm for retaining the hook support arm in a latching position;

a reset weight arm pivotably attached to the at least one latch base, the reset weight arm being in removable contact with the hook support arm for biasing the hook support arm in the latching position; and an actuatable latch pin in removable contact with the locking arm to release the locking arm.

9. The releasable attachment system according to claim 8, wherein the hook support arm comprises:

a first hook support arm end for supporting one of the rotatable hooks; and a second hook support arm end opposite the first hook support arm end having a greater mass than the first hook support arm end for counter-weighting the first hook support arm end;

wherein the first pivot point is positioned generally between the first and second hook support arm ends.

10. The releasable attachment system according to claim 9, wherein the locking arm comprises:

a first locking arm end which removably contacts the hook support arm; and a second locking arm end which removably contacts the latch pin;

wherein the second pivot point is positioned generally between the first and second locking arm ends.

11. The releasable attachment system according to claim 10, wherein the first locking arm end has a greater mass than the second locking arm end to counterweight the second locking arm end.

12. The releasable attachment system according to claim 8, wherein the reset weight arm is pivotably attached at the second pivot point.

13. The releasable attachment system according to claim 8, wherein the reset weight arm is pivotably attached at the second pivot point, and wherein an end of the reset weight arm is spaced apart from the second pivot point farther than the first pivot point is distanced from the second pivot point.

14. The releasable attachment system according to claim 13, wherein the reset weight arm end extends farther from the second pivot point than the first locking arm end of the locking arm.

15. The releasable attachment system according to claim 8, wherein the first pivot point is positioned generally between the one of the plurality of rotatable hooks and the second pivot point.

16. A method for loading a bulk bag with a bulk material, the method comprising:

connecting the bulk bag to a bag filling head of a bulk bag filler by connecting a plurality of bulk bag loops of the bulk bag to a plurality of positionable hooks connected to the bag filling head;

moving the plurality of positionable hooks to a latching position in which each of the positionable hooks is engaged by one of a plurality of gravity driven latch assemblies connected to the bag filling head;

filling the bulk bag with a bulk material;

disengaging each of the plurality of gravity driven latch assemblies to release each of the plurality of positionable hooks and allowing the latch assemblies to return to the latching position through gravity induced motion; and disconnecting the filled bulk bag from the bag filling head by removing the bulk bag loops of the bulk bag from the plurality of positionable hooks.

17. The method of claim 16, wherein the engaging of each of the positionable hooks comprises:

rotating in a first direction, by force of the positionable hook, a hook support arm pivotably connected to the bag filling head, the hook support arm including a first hook support arm end and a second hook support arm end having a greater mass than the first hook support arm end for counter-weighting the first hook support arm end; and supporting the positionable hook with the first hook support arm end of the hook support arm.

18. The method of claim 17, wherein the engaging of each of the positionable hooks further comprises rotating the hook support arm in a second direction, opposite the first direction, by force of a reset weight arm movably attached to the bag filling head.

19. The method of claim 17, wherein the engaging of each of the positionable hooks further comprises supporting the hook support arm in the latching position with a locking arm which is pivotably attached to the bag filling head and in removable contact with an actuatable latch pin.

20. The method of claim 19, wherein the disengaging of each of the positionable hooks comprises removing the latch pin from contact with the locking arm.

* * * * *